US005235307A

United States Patent [19]

Oh

[11] Patent Number: 5,235,307

[45] Date of Patent: Aug. 10, 1993

[54] SOLDERLESS CARTRIDGE FUSE

[75] Inventor: Seibang Oh, Elk Grove Village, Ill.

[73] Assignee: Littelfuse, Inc., Des Plaines, Ill.

[21] Appl. No.: 927,602

[22] Filed: Aug. 10, 1992

[51] Int. Cl.[5] ..... H01H 85/143; H01H 85/165

[52] U.S. Cl. ..... 337/228; 337/248; 337/252

[58] Field of Search ..... 337/228, 248, 246, 249, 337/250, 251, 252, 253, 236, 227

[56] References Cited

U.S. PATENT DOCUMENTS 1,485,211 2/1924 Berger .
2,876,312 3/1959 Frederick .
3,962,668 6/1976 Knapp, Jr. .
4,920,327 4/1990 Arikawa et al. .

*Primary Examiner*—Harold Broome

*Attorney, Agent, or Firm*—Wallenstein, Wagner & Hattis, Ltd.

[57] ABSTRACT

A solderless cartridge fuse comprises an open-ended insulating housing made of a relatively rigid, unyielding material. End caps close the open ends of the housing. Each end cap comprises an end wall confronting the adjacent housing end and a flexible yieldable side wall which, in its pre-formed state, has a lesser size than the periphery of the adjacent end of the housing so that there is a tight interference fit between the conductive end cap side wall and the housing periphery. A fuse element extends diagonally across the interior of the housing. Prior to application of the end caps to the housing ends during fuse assembly, the fuse wire ends are bent back around the housing ends so to be tightly sandwiched between the side walls of the end caps and the housing when the end caps are applied thereover.

29 Claims, 3 Drawing Sheets

Fig. 1
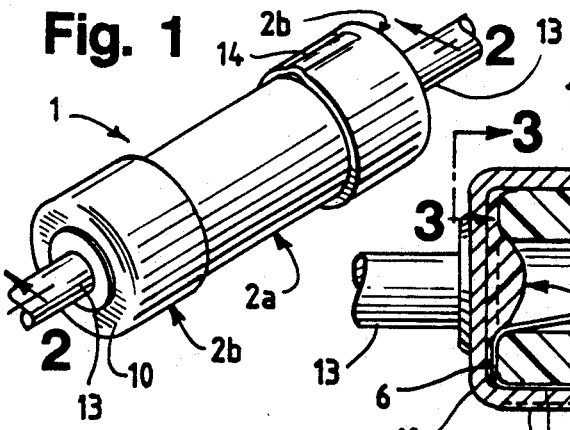
Fig. 2
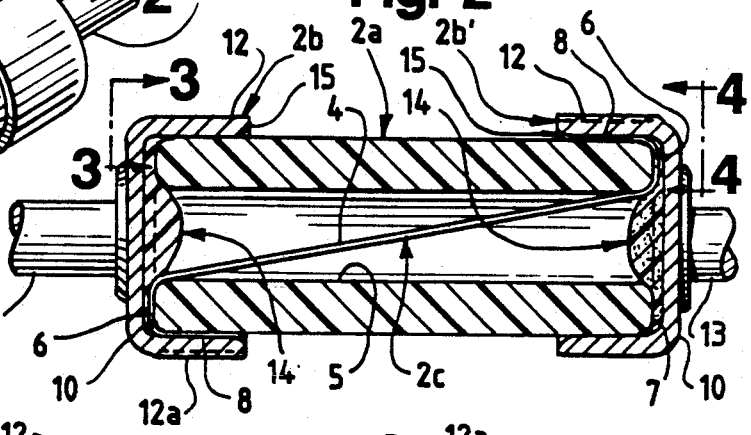
Fig. 3
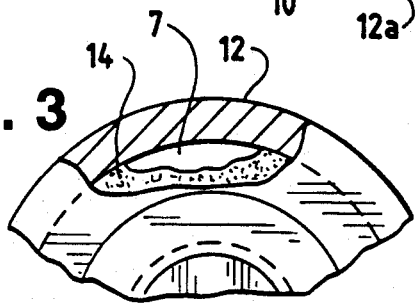
Fig. 4
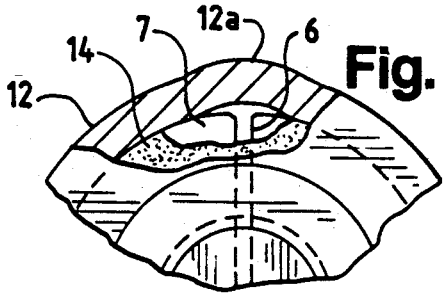
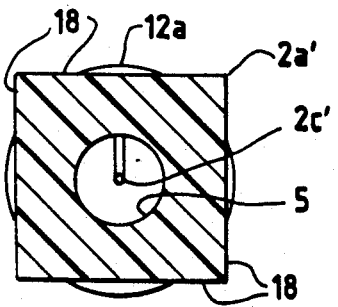
Fig. 11
Fig. 5
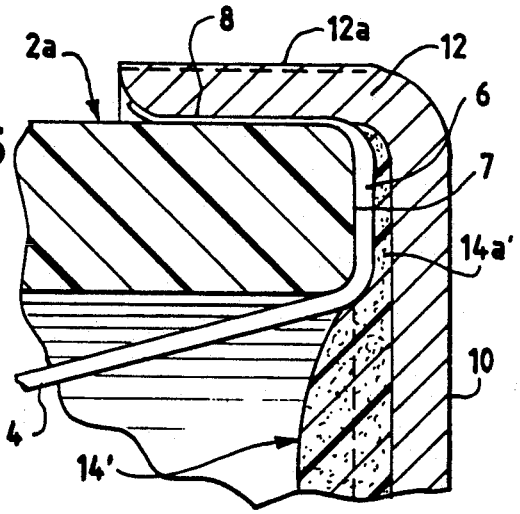
Fig. 9
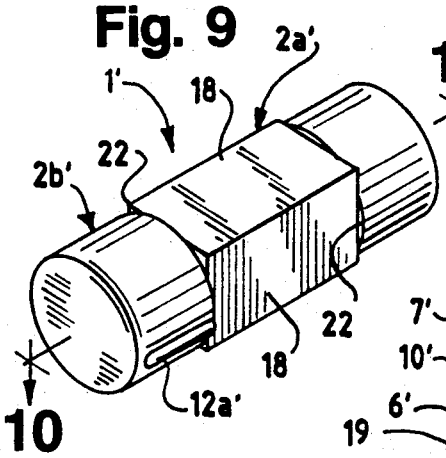
Fig. 10
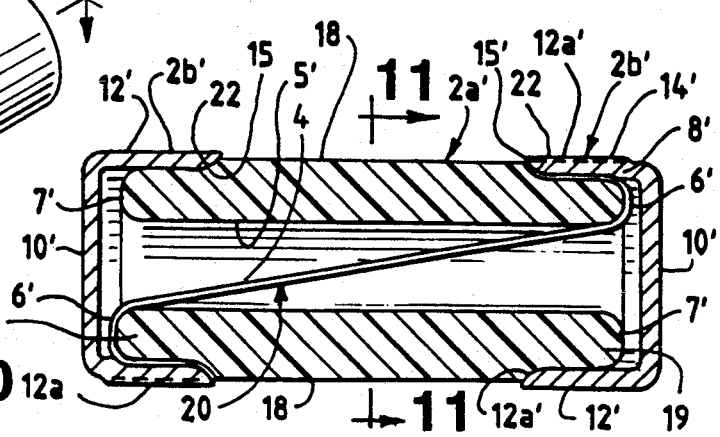

Fig. 12
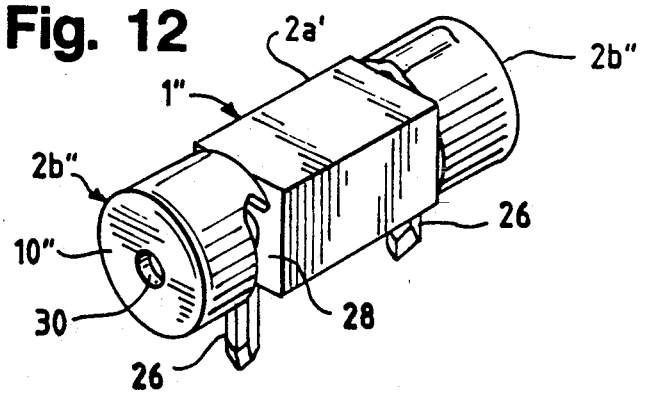
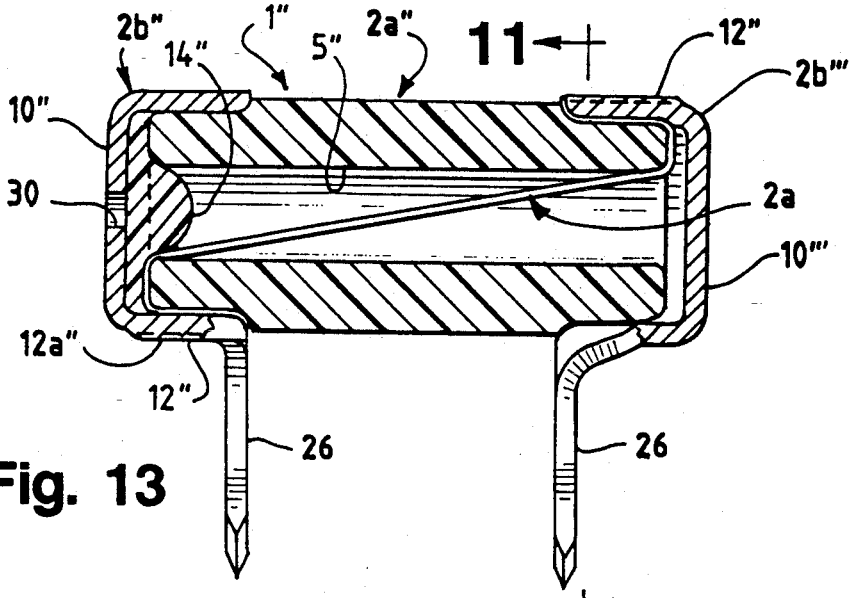
Fig. 13
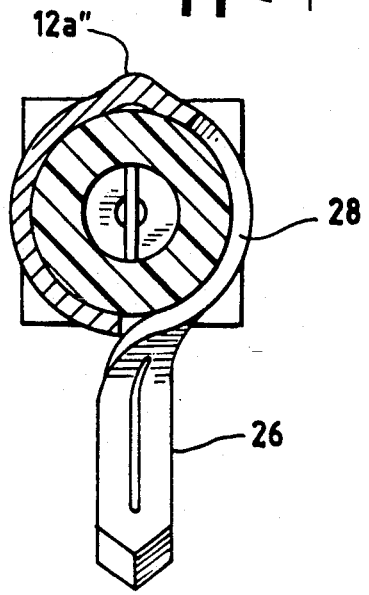
Fig. 14

SOLDERLESS CARTRIDGE FUSE

TECHNICAL FIELD OF INVENTION

The present invention relates to cartridge fuses and has its most important but not its only application to miniature cartridge fuses which can be mass-produced at minimum cost and can withstand substantial short circuit currents without exploding, despite their small size. By miniature cartridge fuses is meant a fuse where the outer diameter of the main housing of the fuse is no more than about 0.30".

BACKGROUND OF INVENTION

Miniature cartridge fuses commonly include a main insulating housing made of a rigid material which is sometimes glass, but more commonly a stronger material, like a ceramic material. In fast blowing fuses, a fuse wire generally extends diagonally across a longitudinal housing passageway, with the wire ends bent back over the housing ends. In slow blowing fuses, the fuse wire may be a winding of fuse wire on an insulating core extending axially of the housing passageway. The ends of this fuse wire winding may be bent back over the housing ends. Cup-shaped end caps extend over the ends of the housing and the bent back ends of the fuse wire fit between the side walls or flanges of the end caps and the housing exterior. Typically, the ends of the fuse element are electrically and physically secured to the end caps by a body of solder in each of the end caps. The solder generally extends into small clearance spaces between the flanges of the end caps and the housing.

To prevent the end caps from falling off the housing under normal handling conditions and under short circuit blowout conditions, a shrink sleeve or an encapsulation material has been applied around the housing and the end caps. The encapsulation material is preferably applied in a manner which also forms a seal around the end caps and the inner end portions of any outwardly extending leads, if provided, to seal the interior of the fuse from printed circuit board cleaning chemicals where the fuse is used on printed circuit boards. The elimination of solder and the shrink sleeve or encapsulation would significantly reduce production costs. The fuses of the present invention, which do so, are useful where cost considerations are of paramount importance for a fuse of a given desired interruption or blowout capacity. Also, it is desired that low cost by well known or other mass on techniques.

Efforts have been made to produce solderless cartridge fuses. As disclosed in U.S. Pat. No. 3,962,668, one such prior art solderless fuse uses a compressible housing made of a cellulose material where the side walls of flanges of cup-shaped end caps are forced over the ends of the housing so that the housing deforms under the force applied by the end cap flanges. The fuse wire has bent back ends held between the end cap flanges and the housing ends. The use of such a housing material is undesirable for a number of reasons. One reason is that such a housing does not have as much strength to withstand high overload currents without exploding and thus has modest overload current capabilities.

Another form of a solderless cartridge fuse is shown in U.S. Pat. No. 2,876,312. It uses a rigid, unyielding housing and cup-shaped end caps with flanges crimped over the outer ends of the housing to compress the bent back ends of the fuse wire between the end cap flanges and the housing. This type of cartridge fuse construction is undesirable because, among other reasons, the crimping of the end caps around the housing ends can cause cracking of the housing, especially in miniature fuses where the housing walls are typically very thin.

One type of fuse which is commonly solderless because of its nature is a renewable cartridge fuse. Such a fuse has removable end caps so that a blown fuse wire can be replaced so the fuse can be re-used. Because of cost and size requirements of such a fuse, and the inherent necessity that the end caps and fuse wire be readily removable and hence free of solder connections, the design details of such a fuse for the most part are not applicable to the one fuse cartridge fuses of the present invention. An example of such a solderless renewable fuse is disclosed in U.S. Pat. No. 1,485,211 to Berger, granted Feb. 26, 1924. It discloses a solderless fuse which includes cylindrical end caps with tightly press against bent back ends of a fuse wire pressed by the skirt portion of the end caps into tapered recesses in the end portions of the fuse housing. The end wall of each end cap bears against the portion of the end of a fuse wire centered in the fuse housing which bends at right angles to the fuse axis as it leaves the housing passageway.

As will appear, the present invention utilizes a technique of assembly which heretofore was believed to be an assembly method which would in most cases break the fuse wire. Especially in miniature fuses which use very fine filament wire, an interference fit between the end cap flanges and the housing in the presence or absence of the fuse wire was not considered feasible, since the assembly of the end caps over the housing would be expected to stretch and break the fuse wire. This problem was of concern to the patentee of U.S. Pat. No. 4,920,327.

To avoid this problem, in the fuse disclosed in this patent recesses were placed in the housing periphery at the ends thereof into which the bent back ends of the fuse wire extended, so that the base portions of these bent back portions of the fuse wire would not be engaged and thereby stretched as the end caps of the housing are pushed over the housing ends. This fuse, however, utilized solder in the end caps. For this reason and the presence of the recesses the cost of the fuse is significantly greater for a given fuse size and interruption capacity than fuses made in accordance with the various forms of the present invention.

SUMMARY OF THE INVENTION

In one form of the invention the bent-back ends of a fuse wire may extend tautly, where desired, diagonally across an insulating housing passageway and be physically and electrically connected to the flanges of the end caps without use of solder or danger of frequent fuse wire breakage during assembly. To this end, the fuse housing has annular end faces with rounded inner and outer margins gradually merging into the outer and inner surfaces of the housing. Where the housing desirably is a rigid body, the flanges of the end caps must be sufficiently flexible that they slightly bulge outwardly as they pass over the compressed bent back ends of the fuse wire. When the end caps are pushed over the housing ends, the rounded outer margins of the end faces of the housing guide the end caps into place over the housing ends. Any small amount of stretching of the bent back end portions of the fuse wire as a result of the movement of the end caps over the housing, short of breaking the wire because of the tension forces involved, will not cause breakage of the fuse wire as would occur, for example, if these rounded margins were not present.

According to another feature of the invention, an interference fit between the end cap flanges and housing is selected so that the bent backed portions of the fuse wire engage the periphery of the housing with sufficient force that the frictional forces between the bent back ends of the fuse wire and the housing will generally prevent fuse wire-breaking stretching of the fuse wire as the end caps are moved axially inwardly over the outer periphery of the housing during assembly. The outer edges of the end cap flanges preferably have tapered terminations so that the flanges are more easily guided over the rounded outer margins of the housing end faces during assembly. It has sometimes been considered desirable that contact pressure between the end walls of the end caps and the portions of the fuse wire passing over the housing end faces be avoided. This can be avoided by providing stop shoulders on the housing exterior which are engaged by the outer edges of the end cap flanges before the fuse wire is contacted by the end cap end walls. However, as will appear, a most useful form of the invention omits these shoulders so that the end walls of the end caps contact the fuse wire where some fuse wire sagging can be tolerated.

The latter feature of the invention was found desirable when the manufacturing tolerances of the end cap and housing dimensions are such as to sometimes result in fuse wire breakage due to undue stretching of the fuse wire during assembly of the end caps on the housing. This breakage occurs at points between the end cap flanges and the housing. The complete collapse of a fuse wire tautly diagonally extending across the housing passageway is prevented by the end walls of the end caps contacting the portions of the fuse wire passing over the end faces of the housing before collapse of the fuse wire occurs. The interference fit of the end cap flanges with the housing supplies adequate end cap pull strength and the pressure of the end walls of the end caps against the fuse wire gives good electrical contact with the unsevered portion of the fuse wire without the need of solder. If an insulating arc quenching material is to be used in the fuse, in accordance with another feature of the invention, a well is formed in the central portion of the end walls of the end caps which is filled with the arc quenching material. While such a well has been heretofore used to hold solder, it is believed unique to use such a well to hold an arc-quenching material.

The result of one or more of these features of the invention is that a fuse can be reliably assembled and constructed at a minimum cost which does not require the presence of solder, shrink tubing or encapsulation to give the fuse the desired low resistance and the strength to withstand the blowout conditions involved because of the secure intimate physical and electrical connection between the end cap flanges and the confronting portions of the bent back ends of the fuse wire or between the end cap end walls and the confronting portions of the fuse wire should the axial movement of the end cap flanges during assembly stretch the fuse wire to a breaking point.

Especially in the form of the invention where the fuse is a printed circuit, surface-mounted fuse devoid of leads, in accordance with another feature of the invention, one or both of the end caps are provided with pressure-relieving apertures which are initially sealed by a sealing material which can also be a non-conductive arc-quenching material. Under short circuit conditions, the pressure within the fuse housing can be relieved to avoid a hazardous destruction of the fuse. Thus, pressure in the fuse housing is relieved as this pressure blows the sealing material out of the end cap pressure-relieving aperture or apertures. While the provision of pressure-relieving apertures in the end caps of fuses sealed by balls of solder is old in the art, the use of an insulating material like the plastic arc quenching material described above for this purpose is believed novel in the fuse art. This avoids the short circuit and physical hazards of solder blown through these apertures of prior art fuses.

The pressure relieving aperture in one or more of the end walls of the end caps can be utilized even where the fuse has axial leads. However, this requires a special shaping of the base portions of the leads so that an initially sealed pressure-relieving aperture will be exposed at the periphery of the leads. This is difficult to achieve in a miniature fuse.

The above and other features of the invention will become apparent upon making reference to the specification to follow, the drawings and claims.

DESCRIPTION OF DRAWINGS

FIG. 1 is a perspective view of a cylindrical cartridge fuse of the present invention where the fuse has axial leads and a cylindrical shape throughout;

FIG. 2 is a longitudinal sectional view through the fuse of FIG. 1 as seen along viewing plane 2—2 in FIG. 1;

FIG. 3 is an enlarged fragmentary lefthand end view of the fuse shown along viewing plane 3—3 in FIG. 2 partly broken away;

FIG. 4 is an enlarged fragmentary and righthand end view of the fuse shown along viewing plane 4—4 in FIG. 2, partly broken away;

FIG. 5 is a greatly enlarged fragmentary sectional view of the righthand end of the fuse shown in FIG. 2;

FIG. 9 is a perspective view of a printed circuit surface mounted fuse constructed in accordance with the present invention;

FIG. 10 is a horizontal longitudinal sectional view through the fuse shown in FIG. 9, taken along viewing plane 10—10 therein;

FIG. 11 is a vertical transverse sectional view through the fuse shown in FIG. 10, taken along viewing plane 11—11 herein:

FIG. 12 is a perspective view of a cartridge fuse similar in some respects to the fuse shown in FIGS. 9–11, except that it has incorporated into the end caps thereof a pair of laterally projecting, parallel plug-in terminals, and a pressure-relieving aperture;

FIG. 13 is a vertical longitudinal sectional view through the fuse of FIG. 12; and FIG. 14 is a transverse section through the fuse of FIG. 13 taken along viewing plane 14—14.

FORM OF THE INVENTION SHOWN IN FIGURES 1-5

Figure 6:
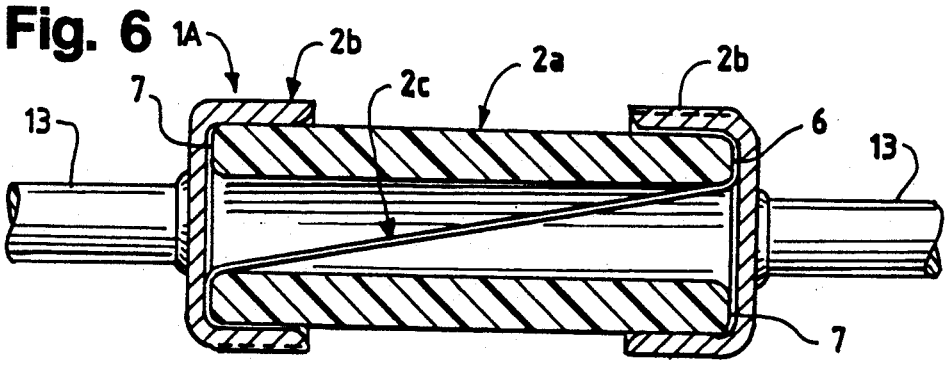
FIG. 6 is a longitudinal sectional view of the preferred, least expensive form of the invention.

The cylindrical fuse 1 shown in FIGS. 1-5 includes a cylindrical housing 2a made of an unyielding material, like a ceramic material, metal cylindrical end caps 2b—2b and a fuse wire 2c. The main portion 4 of the fuse wire extends tautly diagonally across the opposite end of a longitudinal cylindrical passageway 5 within the housing 2a. The ends of the fuse wire have first portions 6—6 extending over annular end faces 7—7 of the housing 2a, and second end portions 8—8 which are sandwiched between the cylindrical flanges or side walls 12—12 of the end caps 2b—2b and the periphery of the housing 2a. The annular end faces 7—7 of the housing 2a merge with the outer periphery of the housing 2a and the defining walls of the internal passageway 5 in smooth rounded surfaces, so that there are no sharp edges to bite through the fuse wire.

As illustrated, the end caps 2b—2b have conductive leads 13—13 extending axially outwardly from end walls 10—10 thereof. However, the present invention is applicable to fuses where the end caps have no leads, as in the case where the end caps are to be received in fuse socket terminals or where the fuse is mounted on the surface of a printed circuit board. Fuses having cylindrical housings and end caps are less desirable for surface mounting on printed circuit boards since they readily roll on the board unless held in place during the soldering of the end caps thereof to conductive areas on the board. The fuse 2' shown in FIGS. 5-11 is more suitable for surface mounting on a printed circuit board because the central portion of the housing thereof has a square profile.

As previously indicated, one of the novel aspects of the present invention is the unique parts tolerances which enable the fuse to be a solderless fuse capable of reliable, low cost assembly by conventional or other assembly techniques. Thus, the preferred dimension tolerances are such that the internal diameter of the end cap flanges 12—12 are, in practically all cases, smaller than the outer diameter of the housing 2a, so that there is an interference fit between the end cap flanges 12—12 and the housing periphery, even in the absence of the fuse wire 2c. However, in accordance with the broadest aspect of the invention, the interference fit can occur only in the presence of the back bent ends of the fuse wire. In either event, the end cap flanges 12'312 are preferably sufficiently thin as to flex outward as the end caps are pressed over the smaller housing periphery and the compressive force of the fuse wire creates sufficient friction between the fuse wire and the housing periphery that the fuse wire does not slide at all along the housing periphery as the end cap flanges move thereover or not enough to stretch the fuse wire to a breaking point. When the end caps 2b—2b are pushed over the outer ends of the housing 2a in the process of assembly of the fuse, the end cap flanges 12—12 mash the bent over end portions 8—8 of the fuse wire to spread it over part of the periphery of the housing. The flanges bulge a small amount to follow the profile of the deformed fuse wire ends, as shown at points 12a—12a. The resulting intimate physical and electrical contact between the end cap flanges and the bent back end portions 8—8 of the fuse wire make an extremely low resistance, secure interconnection between the end caps and the ends of the fuse wire without the need of solder.

The ends of the end flanges 12—12 have tapered end edges to help in guiding the movement of the flanges of the end caps into position over the smaller profile of the housing 2a.

In such a fuse as just described, it is exceedingly important to avoid severance of the fuse wire at the points where the fuse wire enters the interior of the housing as the end caps are pressed over the ends of the housing, since if this occurred the fuse wire, which desirably is tautly stretched across and around the ends of the housing, would completely collapse and the fuse would be inoperative to perform its fusing function. The pressure of the end cap end walls on the portion of the fuse wire passing over the housing end faces could cause such a severance if the housing end faces joined the outer and inner surfaces of the housing in sharp or unrounded corners.

The sliding of the inner surfaces of the end cap flanges along the bent back end portions desirably also should not stretch and elongate the fuse wire to an extent which would break the fuse wire either through tension on the wire or by wire tension which forces the wire against such sharp or unrounded corners. As previously indicated, an interference fit between end cap flanges and a housing with the fuse wire bent back thereover to project beyond the housing periphery was not heretofore considered feasible. Recesses were placed in the housing ends to receive the fuse wire, as shown in U.S. Pat. No. 4,920,327 which discloses a solder-containing fuse, to avoid stretching and thus severing the bent back ends of the fuse wire as the end cap flanges are moved along the housing periphery during assembly of the fuse. The solderless and encapsulation-free form of the present invention to achieve sufficient end cap pull strength cannot use such recesses. Rather, a preferably tight interference fit between the end cap flanges and housing is desired.

It is sometimes desirable that bodies 14—14 of an insulating arc-quenching material be placed in the end caps before assembly of the fuse. Initially the bodies of arc-quenching material are flat discs of even thickness. When the end caps are pushed with a modest force over the housing ends during fuse assembly, the disc-shaped bodies of arc-quenching material are compressed against the housing end faces so that part of these discs are forced into the housing passageway 5 where they form projecting globs of the material. Some of the arc-quenching material at 14a' (FIG. 5) remains between the fuse wire and end cap end walls. It is preferred that this arc-quenching material prevent a sufficient force from being transmitted to the fuse wire end portions 6—6 that this will not cause sagging of the center portion of the fuse wire most desirably tautly diagonally extending across the housing interior.

If the blowing tolerances are sufficiently modest that some sagging of the fuse wire can be tolerated and an arc-quenching material is not needed, then this material can be completely eliminated from the fuse shown in FIG. 1, as shown in FIG. 6 to further reduce the cost of manufacture of the fuse.

EMBODIMENT OF THE INVENTION SHOWN IN FIG. 6

The fuse 1A shown in FIG. 6 is identical to the fuse shown in FIG. 1, except that the arc-quenching material 14 has been removed therefrom to overcome a problem which can occur in the fuse shown in FIG. 1 This problem is that, in some instances, because of less than ideal dimension tolerance, during the sliding of the end caps 2b—2b over the ends of the housing 2a the fuse wire 2c stretches to a point which will break the fuse wire at points between the end cap flanges and the periphery of the housing. If the end faces of the housing did not have rounded margins, this stretching could readily cause breakage of the fuse wire also at the points where it passes over the end faces of the housing. In such case, the fuse wire within the housing interior would collapse completely.

It was surprisingly discovered that, in those cases where the fuse wire is stretched to a breaking point at points between the end cap flanges and the housing periphery, the quick application of the end caps over the fuse housing during assembly results in the capture of the fuse wire between the end walls of the end caps and the end faces of the housing before the fuse wire collapses. This capture results in a good low resistance contact between the fuse wire and end caps without the need of solder, provided no insulating arc-quenching material is present between the fuse wire and end caps at the points of contact therebetween.

Exemplary specifications for the fuse shown in FIG. 6 for a 1.0 amp fuse are:

| |
|---|
| Housing 2a: Ceramic |
| Material - Ceramic |
| Length - .244 ± .003 |
| Wall Thickness - ID .035 ± .002 |
| OD .0775 + .0000 |
| (give tolerances) - .0015 |
| End Caps 2b—2b: |
| Material - Silver plated brass |
| Wall Thickness: .005 ± .001 |
| (give tolerances) ID: .0755 ± .0005 |
| Fuse Wire 2c: |
| Material - Silver-copper alloy wire |
| Length - .350 |
| Diameter - .0013 |
| (give variation with various current rating) |
| Short Circuit Rating - 125 VAC 50a |

Figure 7:
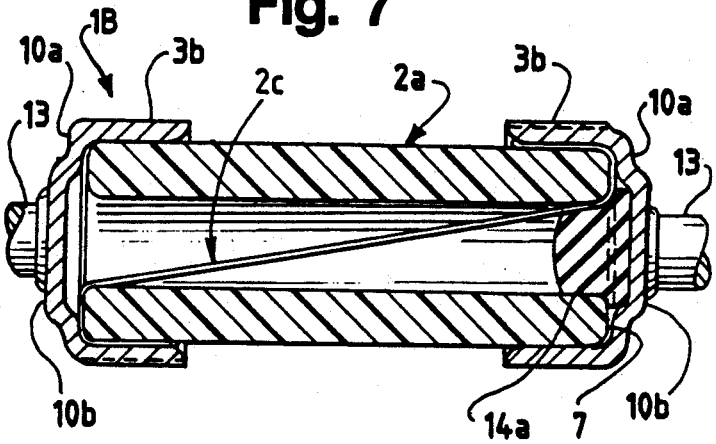
FIG. 7 is a longitudinal sectional view of a modified form of the invention shown in FIG. 6 where provision is made for an arc-quenching material in a well formed in the center portions of the end caps.

EMBODIMENT OF THE INVENTION SHOWN IN FIGS. 7, 7A AND 8

Where there is a need for arc-quenching material within the fuse, the end caps are modified as shown in FIG. 7 to provide wells for the arc-quenching material at points removed from the points of contact between the end caps and the fuse wire.

Figure 7A:
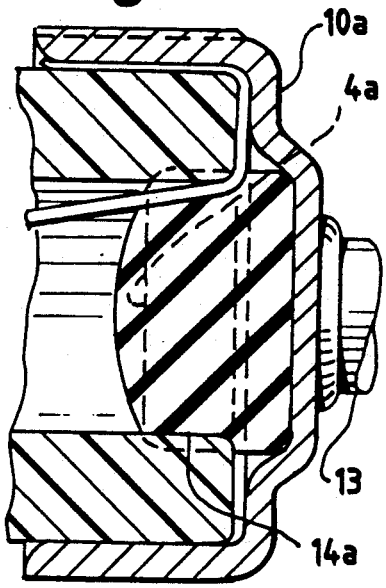
FIG. 7A is a greatly enlarged fragmentary sectional view of the righthand end of the fuse shown in FIG. 7.

As there shown, the end walls of the end caps of the modified fuse 1B have outer annular portions 10a—10a confronting the housing end faces 7—7. Well-forming portions 10b—10b are provided in the central portions of the end walls to hold the arc-quenching material in one or both wells. Before assembly, a pellet 14a shown in dotted lines in FIG. 7A is placed in one of the end caps as shown in FIG. 7. The annular outer portion 10a—10a of the end caps 10—10 confront only approximately one-half of the width of the housing end faces 7—7. When the end caps are pushed over the housing ends, the pellet 14a of arc-quenching material is engaged by a portion of the adjacent housing end faces which press portions of the pellet into the housing interior The arc-quenching material is not then pressed outwardly to a point where it reaches the interface between the fuse wire and end cap wall portions 10a—10a.

Figure 8:
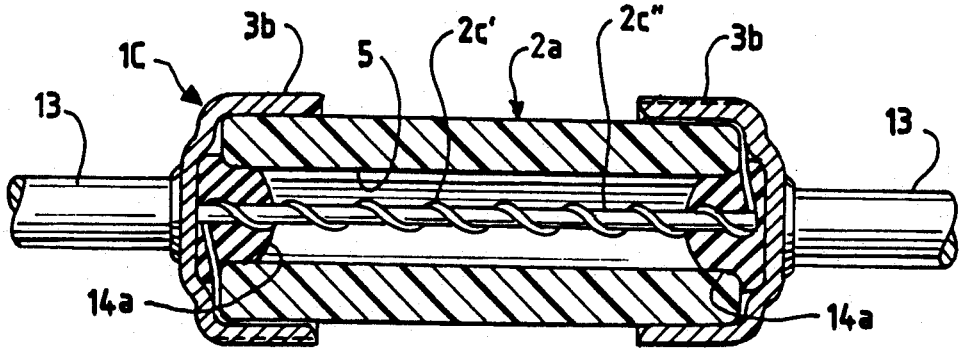
FIG. 8 is an longitudinal sectional view of a modified form of the invention shown in FIG. 7 where the fuse element is a spiral wound element.

FIG. 8 shows a fuse 1C of the same construction shown in FIG. 7, except that both end caps have arc-quenching material 14a and the fuse wire 2c' is a fuse wire spirally wound on an insulating core 2c'' extending axially within the center of the housing passageway 5. The ends of the fuse wire are bent back over the housing end faces and have the same relationship to the end caps as does the fuse 1B just described.

EMBODIMENT OF THE INVENTION SHOWN IN FIGS. 9-11

While the fuses 1, 1A, 1B and 1C shown in FIGS. 1, 6, 7 and 8 respectively could be used as a surface mounted fuse on a printed circuit board if the leads 13—13 were omitted, the cylindrical shape of those fuses makes it more difficult to mount on a printed circuit board. Thus, when such a leadless fuse is deposited on the board it will roll unless it is held in place by the fuse applying equipment involved.

FIGS. 9-11 show a leadless and solderless fuse 1' having its most important application as a fuse to be mounted on a printed circuit board.

The housing 2a', which can be made of the same material as the housing 2a in FIG. 1, has a central portion having a rectangular profile so as to present four flat axially extending surfaces 18 falling along the outlines of a square. The central portion of the housing terminates in end portions 19—19 having a cylindrical outer profile of a smaller size diameter than the central portion of the housing, to provide outwardly facing abutment shoulders 22—22.

The end caps 2b'—2b' of the fuse 1' can have the same cylindrical shape as the end caps 2b—2b of the fuses 1 and 1A previously described. The inner diameter of the end cap flanges 12'—12' are sized to make an interference fit with the cylindrical periphery of reduced end portions 19—19 of the housing 2a'. The ends of the flanges 12'—12' of the end caps 2b'—2b' are tapered so as to guide the end caps into position over the housing 2a'.

The fuse 1' has a fuse wire 2c' which has outer end portions 6'—6' extending over the rounded annular end faces 7'—7' of the housing and end portions 8'—8' which bend back around the ends of the housing to be sandwiched between the housing end portions 19—19 and the end cap flanges 12'—12' in the same manner as this occurs in the embodiment of the fuse 2 shown in FIGS. 1-5. The end cap side flanges thus will bulge slightly at 12a'—12a' where they engage and mash the fuse wire end portions 8'—8'.

One of the main differences between the fuse 1' of FIGS. 9-11 from the fuse 1 in FIGS. 1∝5 is that the housing shoulders 22—22 act as stopping points for the tapered end edges 15'—15' of the end cap flanges 12'—12', so that the end walls 10'—10' of the end caps are kept spaced from the annular end faces 7'—7' of the housing and the bent back fuse wire portions 6'—6'. Since the end cap end walls 10'—10' do not contact the fuse wire 2c', the problem of compressing the end portions of the fuse wire which can cause sagging of the fuse wire is avoided. If the short circuit blowing conditions are modest, then no arc-quenching material is provided.

The thickness of the cylindrical flanges 12'—12' of the end caps 2b'—2b' is greater than the degree to which the end portions 19—19 of the housing 2a' are recessed within the periphery of the square-shaped central portion of the housing 2a, so that the end caps project beyond the periphery of the housing 2a'. Thus, when the fuse 1' is placed on the flat surface of a printed circuit board, the metal end caps will contact the spaced conductive areas of the circuit board where they can be readily soldered thereto. In those cases where the fuses are randomly placed upon the printed circuit board, and the bulged portions 12a'—12a' of the end cap flanges will rest upon the space conductive areas of the printed circuit board, any tendency of the fuse to roll to any substantial degree is prevented by engagement of the square-shaped central portion of the housing with the printed circuit board.

The cost of making the fuse housing 2a' in the odd shape shown in FIG. 9 is greater than that for making the simply shaped cylindrical housing of the fuses 1 and 1A. However, the cost of making the surface mounted fuse 1' is reduced by eliminating the need for an arc quenching material.

Combination Surface-Mounted and Plug-In Fuse of FIGS. 12-14

The fuse 1'' shown in FIGS. 12-14 is similar to the fuse 1' just described insofar as the size and shape of its housing 2a'' and the size and relationship of the end cap flanges 12''—12'' to the housing periphery are concerned. The fuse 1'' is unique from the fuses 1 and 1' in that one of the end caps 2b'' has a pressure-relief aperture 30 in the end wall 10'' and the end caps 2b''—2b''' have downwardly projecting plug-in terminals 26—26. These terminals are tabs struck from the portions of the sheet metal from which the side walls 12''—12''' of the end caps are formed. Thus, the end cap side walls have slots (see FIG. 14) where which these tabs or terminals 26—26 were originally located. The terminals 26—26 can be plugged into a socket in a printed circuit board or other mounting body. The fuse 1'' can also be used as a conventional surface-mounted fuse when the fuse 1'' is oriented so that the terminals 26—26 extend away from the surface of the printed circuit board. In such case, the end caps 2b''—2b''', which extend beyond the periphery of the square-shaped central portion of the housing 2a'', can then be applied to spaced conductive areas on a printed circuit board and then soldered thereto.

Another unique feature of the fuse 1'' is the provision in one of the end caps of a pressure-relieving aperture 30 extending completely through the end wall 10'' of the end cap 2b''. The pressure-relief aperture 30 is sealed from the exterior of the fuse by a body of sealing material 14'', which may be the same material used as the arc-quenching material in the fuse embodiment shown in FIGS. 1-5. This material is an insulating material having a putty-like consistency. When the fuse blows, in addition to the vaporization of a part of this material to act as an arc-quenching material, the remaining solidified part thereof is blown through the aperture by the pressures built up within the fuse housing passageway to relieve pressure within the fuse housing. The blowing of the soft insulating material 14'' through the aperture 30 is a minimal and inconsequential hazard, as compared to the blowing of the conductive solder used to seal similar pressure-relieving apertures in the end caps of prior art fuses. In general, the aperture 30 is not necessary except under circumstances where the fuse blowing voltage and current conditions are such that one needs the additional pressure relief of the aperture 30.

In accordance with one variation of the fuse shown in FIGS. 12-14, the pressure relieving aperture 30 could be placed in both end walls 10'' and 10''' of the end caps 2b''—2b'''.

While the invention has been described with reference to a preferred embodiment, it will be understood by those skilled in the art that various changes may be made and equivalents may be substituted for elements thereof without departing from the broader aspects of the invention. Also, it is intended that broad claims not specifying details of a particular embodiment disclosed herein as the best mode contemplated for carrying out the invention should not be limited to such details. Furthermore, while, generally, specific claimed details of the invention constitute important specific aspects of the invention in appropriate instances even the specific claims involved should be construed in light of the doctrine of equivalents.

I claim:

1. A cartridge fuse comprising: an insulating housing made of a relatively rigid, unyielding material and having at least one open end defined by an end face thereof, a central portion merging with opposite longitudinal end portions thereof; an end cap for closing each open end of the housing, each end cap comprising an end wall confronting the adjacent open end of said housing and a flexible yieldable side wall which, in its preformed state, has a lesser size than the periphery of the adjacent longitudinal end portion of said housing so that there is an interference fit between the conductive end cap side wall and said housing which fit retains said end cap thereover; and an initial overload current circuit-interrupting fuse element in the interior of said housing the ends of which are connected to the end caps at each open end of the fuse housing, to initially open the circuit to which the fuse is connected on overload thereof, and at each open end of the housing said fuse element being bent back thereat around the end thereof so as to be tightly sandwiched between the side wall of the adjacent end cap and the housing, thereby making a low contact resistance connection with the end cap side walls without the need of solder at said open end to do so; and said fuse being devoid of such solder at each open end of said housing.

2. A cartridge fuse comprising: an insulating housing made of a relatively rigid, unyielding material and having at least one open end defined by an end face thereof, a central portion merging with opposite longitudinal end portions thereof; an end cap for closing each open end of the housing, each end cap comprising an end wall confronting the adjacent open end of said housing and a side wall which, in its pre-formed state, has a lesser size than the periphery of the adjacent longitudinal end portion of said housing, so that there is an interference fit between the conductive end cap side wall and said housing periphery which fit retains said end cap thereover; and a fuse element in the interior of said housing, and at each open end of the housing said fuse element being bent to extend over the adjacent housing end face, said end wall confronting the adjacent housing end face and pressing against said bent end of said fuse element passing over said housing end face to make a low contact resistance connection with the end wall of the associated end cap without the need of solder at said open end to do so; and said fuse being devoid of such solder at each open end of said housing.

3. The cartridge fuse of claim 2 wherein said fuse element is bent back around the adjacent end of the housing so as to be tightly sandwiched between the side wall of the adjacent end cap and the housing body.

4. The cartridge fuse of claim 2 wherein each end cap end wall has an outer annular portion pressed against the bent portion of the fuse element passing over the adjacent housing end face and an outwardly projecting well-forming central portion providing a well for receiving an arc-quenching material.

5. The cartridge fuse of claim 4 wherein the well of at least one end cap contains said arc-quenching material.

6. A cartridge fuse comprising: an insulating housing having a central portion merging with opposite longitudinal end portions, at least one of which has an opening in an end face thereof communicating with a longitudinal passageway in the housing; an end cap for closing each open end of the housing, each end cap including an end wall confronting the adjacent housing end and a conductive side wall enveloping the adjacent longitudinal end portions of the housing; a fuse element in said passageway extending through said housing, the fuse element at each open end of the housing being bent back over the adjacent housing end to extend over and project beyond the housing periphery to pass and be entirely located between the end cap side wall and housing periphery; said side wall of each end cap in its pre-formed state having an inner dimension which makes a sufficiently tight interference fit with the adjacent housing end with the fuse element extending thereover that the fuse element is compressed by the end cap side wall against the housing periphery to an extent where the friction between the ben back end of the fuse element and the housing inhibits any fuse element breaking axial movement of the fuse element during assembly; said fuse being devoid of any solder at each open end of said housing; and one of said housing and end cap side walls being sufficiently flexible as to deform slightly as each end cap is moved over the adjacent open end of the housing during assembly, to accommodate the thickness of the adjacent compressed fuse element end.

7. The cartridge fuse of claim 6 wherein each end cap end wall presses against the portion of said fuse element passing over the housing end face to make a low contact resistance connection with the end wall of the associated end cap.

8. The cartridge fuse of claim 6 wherein said insulating housing is made of a rigid unyielding material and said side wall of each end cap is yieldable so it bulges around the adjacent bent back end of the fuse element as the end cap is pushed over the adjacent housing end.

9. The fuse of claim 6 wherein each end cap side wall makes an interference fit with the adjacent periphery of said housing, excluding the presence of the bent back end of the fuse element.

10. The fuse of claim 6 wherein said housing terminates at each open end thereof in a tapered peripheral surface which acts as a surface for guiding the movement of the end cap during assembly into position over the adjacent longitudinal end of the housing.

11. The fuse of claim 6 wherein said housing passageway opens onto both ends of said housing so there is a conductive end cap at each end of the housing.

12. The fuse of claim 10 wherein said tapering is formed by rounding at least the outer end edges of the housing.

13. The fuse of claim 1, 2 or 6 wherein each open end of said housing terminates in an end face with curved margins which merge smoothly with the inner and outer surfaces of the housing whereby the adjacent end of the fuse element can be tautly bent around the end of said housing without severance of the fuse element.

14. The fuse of claim 6 wherein each open longitudinal end portions of said housing is spaced radially inwardly with respect to the central portion of the housing, so as to provide an axially outwardly facing abutment shoulder at an end margin of said central portion of the housing, the inner end of the side walls of each end cap abutting the adjacent housing shoulder, the end wall of each end cap being spaced from the adjacent end of said housing a distance greater than the thickness of the fuse element thereto, so that the only portion which bears against the fuse element to make contact therewith is the side wall of the adjacent end cap.

15. The fuse of claim 6 wherein the central portion of said housing has a consistent square profile.

16. The fuse of claim 15 wherein the central portion of said housing has a consistent square profile, each longitudinal end portion of said housing has a cylindrical shape, and the side walls of each end cap is also of a cylindrical shape, to snugly fit over the adjacent cylindrically shaped end portion of the housing.

17. The fuse of claim 11 wherein the longitudinal end portions of said housing have a cylindrical shape and the side walls of said end caps have a corresponding shape.

18. The fuse of claim 11 wherein said end caps have end walls confronting the open ends of said passageway and side walls enclosing the ends of said housing, and each of said end caps having a rigid prong projecting in the same direction from the side wall thereof, to provide a pair of longitudinally spaced, parallel, confronting plug-in terminals.

19. A cartridge fuse comprising: an insulating housing having a central portion merging with opposite longitudinal end portions, at least one of which end portions terminating in an end face with an opening communicating with a longitudinal passageway in the housing; an end cap slid into position over each open end of the housing, each end cap including an end wall confronting the adjacent housing end face and a conductive side wall enveloping the adjacent longitudinal end portion of the housing; a fuse element in said passageway, the fuse element at each open end of the housing being bent over the adjacent housing end face and extending between the end cap side wall and the housing thereat, the portion of said fuse element between said end cap side wall and said housing being pressed by said side wall against said housing; each open end face of said housing terminating in at least an inner curved margin which merges smoothly with the inner surface of the housing, whereby the adjacent end of the fuse element can be tautly bent therearound without severance of the fuse element.

20. The cartridge fuse of claim 19 wherein said fuse element extends diagonally across said housing passageway, and each said end face of said housing also has a curved outer margin which merges smoothly with the outer surface of the housing, whereby the adjacent end of the fuse element can be tautly bent therearound without severance of the fuse element.

21. The cartridge fuse of claim 19 wherein there is provided means for relieving the pressure within said housing under short circuit blowing conditions, said means including an aperture in at least one of said conductive end caps, and an insulating sealing material on the inside of said latter end cap which seals said opening from the exterior of the fuse, except under high pressure fuse-blowing conditions, wherein the sealing material is blown through the opening to relieve the pressure within the fuse housing.

22. The fuse of claim 21 wherein said sealing material under short circuit conditions is also an arc-quenching material.

23. The cartridge fuse of claim 19 wherein each of said end caps has rigid prongs projecting in the same direction from the side walls thereof to provide a pair of longitudinally spaced, parallel, confronting plug-in terminals.

24. The cartridge fuse of claim 1, 2 or 6 wherein said fuse is a miniature fuse having an outer dimension at right angles to the longitudinal axis thereof no greater than about 0.30".

25. The cartridge fuse of claim 19 wherein said fuse is a miniature fuse having an outer dimension at right angles to the longitudinal axis thereof no greater than about 0.30".

26. The cartridge fuse of claim 21 wherein said fuse is a miniature fuse having an outer dimension at right angles to the longitudinal axis thereof no greater than about 0.30".

27. A method of making a cartridge solderless fuse including an insulating housing having a longitudinal passageway therein opening onto the ends of the housing, a fuse element extending the length of said passageway, and conductive end caps at the outer said longitudinal end of said housing to which the ends of said fuse element are electrically connected, the method comprising the steps of: providing said housing with outer end faces and end caps, each of which comprises an end wall to confront one of the open ends of said housing and a flexible conductive side wall which has an inner dimension which makes an interference fit with the adjacent housing end and a fuse element to extend thereover, so that the friction between the bent back end of the fuse element and the adjacent end of said housing prevents any axial movement of the end cap from bodily pulling the fuse element with the end cap; providing a fuse element which is much longer than the diagonal dimension of said passageway and passing said fuse element through said passageway and bending the opposite ends of the fuse element over the opposite ends of the housing; and forcing each end cap over one of the open ends of the housing with the ends of the fuse element bent thereover, so that the interference fit between the side wall of each end cap and the bent back ends of the fuse element can make a good electrical contact with the adjacent bent back end of the fuse element, without the need of any solder for making electrical connection between the fuse element and the end caps.

28. The method of claim 27 wherein the housing terminates at each open end thereof in a tapered peripheral surface which acts as a surface for guiding the movement of the end cap during assembly into telescoping position over the adjacent longitudinal end of the housing.

29. The method of claim 27 wherein said longitudinal end portions of said housing are spaced radially inwardly with respect to the central portion of the housing, so as to provide axially outwardly facing abutment shoulders at the end margins of said central portion of the housing, the inner ends of the side walls of said end caps abutting said shoulders, the end walls of said end caps being spaced from the ends of said housing a distance greater than the thickness of said fuse element, so that the only portion which bears against said fuse element to make contact therewith are the side walls of said end caps.

* * * * *

UNITED STATES PATENT AND TRADEMARK OFFICE

CERTIFICATE OF CORRECTION

PATENT NO. : 5,235,307

DATED : August 10, 1993

INVENTOR(S) : Seibang Oh

It is certified that error appears in the above-indentified patent and that said Letters Patent is hereby corrected as shown below:

Col. 1, line 49, after "desired that" insert --the fuses be designed to be mass-produced at--.

Col. 1, line 50, after "mass" delete "on" and insert --production--.

Col. 4, line 61, replace "herein" by --therein--.

Col. 5, line 51, replace "12'312" by --12-12--.

Col. 7 - in the Table of Specifications:

The Headings "Housing 2a: Ceramic," "End Caps 2b-2b:," Fuse Wire 2c:," and "Short Circuit Rating - 125 VAC 50a" should be at the left margin and not indented as far as the other entries.

The Headings "Housing 2a: Ceramic" and "Short Circuit Rating" should be underlined.

Under the "Housing 2a:" Heading, the dimension "-.0015" should be on the same line with "+.0000."

Under the "Housing 2a:" Heading, the "OD" line should be indented to align with the "ID" above it.

Under the"Housing 2a:" and "End Caps 2b-2b" Headings, delete "(give tolerances)."

Under the "Fuse Wire 2c" Heading, delete "(give variation with various current rating)."

UNITED STATES PATENT AND TRADEMARK OFFICE

CERTIFICATE OF CORRECTION

PATENT NO. : 5,235,307

DATED : August 10, 1993

INVENTOR(S) : Seibang Oh

It is certified that error appears in the above-indentified patent and that said Letters Patent is hereby corrected as shown below:

Col. 8, line 54, replace "1∝ 5" by --1-5--.

Signed and Sealed this

Twenty-fifth Day of April, 1995

Bruce Lehman

*Attest:*

BRUCE LEHMAN

*Attesting Officer*

*Commissioner of Patents and Trademarks*